US005900851A

United States Patent [19]

Toffolo et al.

[11] Patent Number: 5,900,851

[45] Date of Patent: May 4, 1999

[54] ELECTROLUMINESCENT PANEL DRIVE OPTIMIZATION

[75] Inventors: Daniel Toffolo, Wilton, Conn.; Silviu Palalau, Birmingham; Marian Borzea, Farmington Hills, both of Mich.

[73] Assignee: UT Automotive Dearborn, Inc., Dearborn, Mich.

[21] Appl. No.: 09/078,525

[22] Filed: May 13, 1998

[51] Int. Cl.[6] ..... G09G 5/00

[52] U.S. Cl. ..... 345/76; 345/36; 345/45

[58] Field of Search ..... 345/76, 36, 45, 345/211

[56] References Cited

U.S. PATENT DOCUMENTS 5,337,073 8/1994 Tsunoda et al. ..... 345/76
5,550,557 8/1996 Kapoor et al. ..... 345/76
5,594,463 1/1997 Sakamoto ..... 345/76
5,754,154 5/1998 Katakura et al. ..... 345/97
5,777,611 5/1996 Song ..... 345/212

*Primary Examiner*—Richard A. Hjerpe
*Assistant Examiner*—Kamran Malik
*Attorney, Agent, or Firm*—Howard & Howard

[57] ABSTRACT

A power system for a display, particularly an electroluminescent display, includes a temperature sensor for sensing the temperature of the glass panel. A first power supply circuit supplies a first power output having a first average power and first peak power. A second power circuit generating a second power output having second average power greater than the first average power and a second peak power less than the first peak power.

4 Claims, 1 Drawing Sheet

ELECTROLUMINESCENT PANEL DRIVE OPTIMIZATION

BACKGROUND OF THE INVENTION

The present invention provides an electroluminescent drive system which reduced the potential of screen image "burn in."

It is known that displays, including ELDs, can acquire a "burned in" image after displaying the image for an extended period of time. Some displays dim after a period of inactivity, such as no input on a user input device. Other displays display a "screen saver" or image which moves across the screen, thereby activating different pixels, in order to prevent burn in.

High resolution, reconfigurable displays, such as ELDs, are increasingly incorporated into current vehicles. These displays also have the potential for burned in images. However, screen savers or dim screens cannot be utilized in a vehicle. In a vehicle display, there may be several hours between user inputs on a user input device, but it would be inappropriate to dim the screen or remove the useful information from the display.

SUMMARY OF THE INVENTION

The present invention provides a display system and power supply system for a display, particularly for electroluminescent displays, which reduce the possibility for "burned in" images.

A temperature sensor monitors the temperature of the panel glass in the ELD. When the temperature is below a threshold, the display system uses a power supply configuration which minimizes average power consumed by the display system. When the temperature of the panel glass exceeds the predetermined threshold, the display system switches to a second configuration, in which instantaneous power supplied to the ELD is limited, while permitting average power consumption of the system to increase.

The present invention is premised upon the discovery that an EL display panel is prone to screen burn in when the ELD is at a high temperature. When the temperature of the ELD panel is high, high instantaneous power spikes in the ELD exacerbate screen burn in.

Generally, the display system utilizes a first power supply circuitry which minimizes average power consumption according to known techniques. For example, a resonant circuit can be utilized to minimize the average power consumption by the entire display system, including the FPGA, power conversion circuitry, etc. Although the average power of the display system is minimized, there will be instantaneous power spikes to the ELD panel. These spikes are not harmful to the ELD panel when the ELD panel is cool.

In order to prevent screen burn-in when the temperature sensor detects that the temperature of the panel glass exceeds a predetermined threshold, instantaneous power spikes must be limited. A second power supply circuitry is utilized which limits the instantaneous power consumed by the ELD panel, although increasing the average power consumed by the display system. Preferably, the second power supply circuitry comprises a constant power supply amplifier, such as is known. While the ELD drivers and drive circuitry are switching voltage levels, the second power supply circuitry maintains a constant power supply, thereby eliminating the possibility of high instantaneous power spikes. When the voltage level change is complete, the second power supply circuitry supplies a constant voltage, in order to maintain the constant voltage on the ELD panel.

In this manner, average power supply by the entire display system is normally minimized. However, when the temperature of the ELD reaches a point where a power spike would cause burn in, the configuration of the display system is switched. The second power supply circuitry supplies power to the panel at a constant power level, thereby preventing screen burn in.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
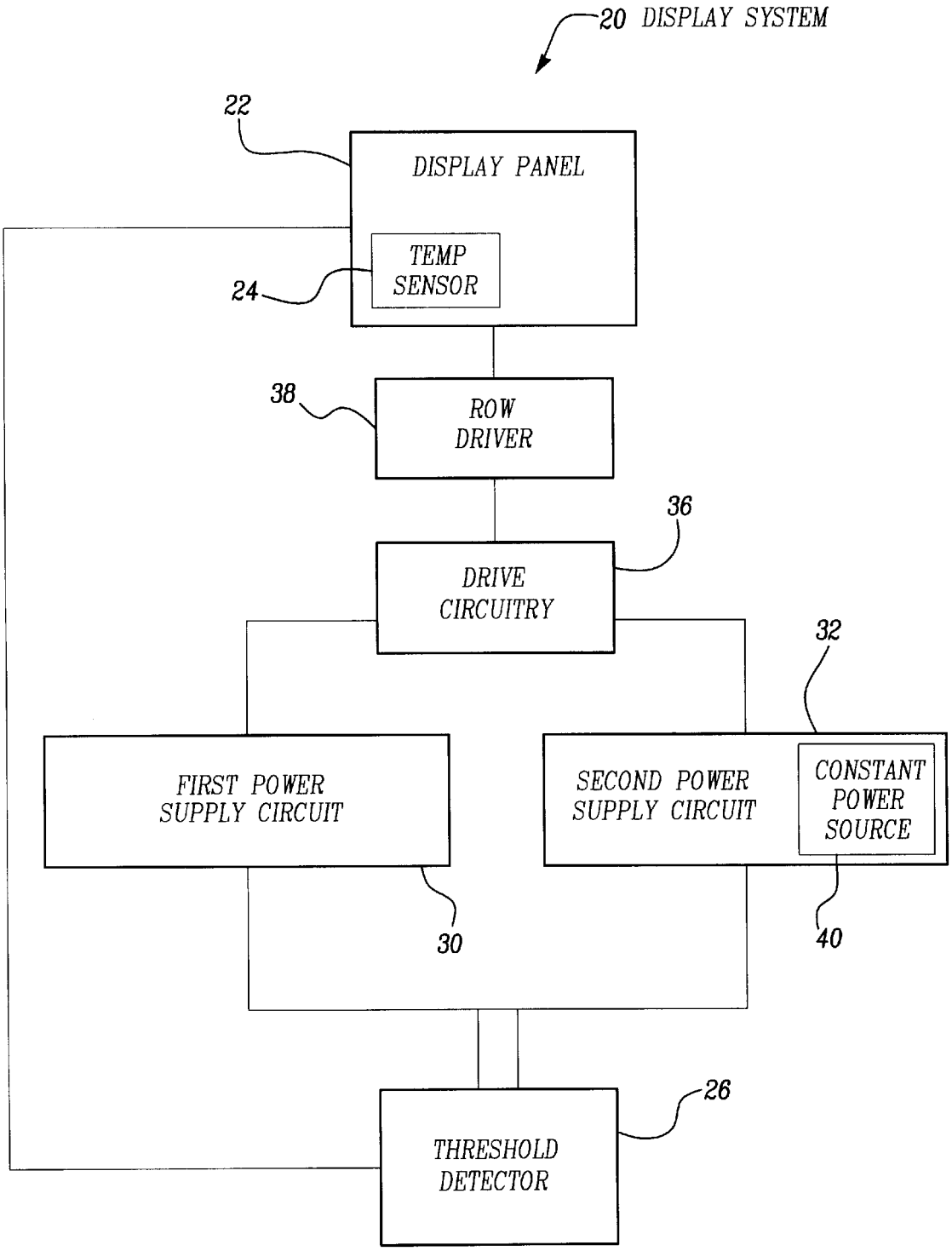
FIG. 1 is a schematic of the present invention.

A display system 20 according to the present invention is illustrated schematically in FIG. 1. The display system 20 of the present invention relates particularly to the supply of power to a display panel 22, particularly an ELD panel 22. Therefore, only the elements related to the supply of power to the panel 22 are shown in FIG. 1. Other elements, such as for providing and defining the image to be displayed on panel 22 (such as an FPGA, VRAM, etc.) are not shown, but well-known to those skilled in the art. The invention is independent of the particular elements utilized.

The display system 20 includes a temperature sensor 24 monitoring the temperature of the display panel 22. Preferably, the temperature sensor 24 is mounted directly on the panel 22 and provides a signal to a threshold detector 26 indicating the current temperature of the panel 22. Generally, the present invention is premised upon the discovery that the panel 22 is more susceptible to "burn-in" when the temperature of the panel 22 is high, e.g. over 150° F. In order to reduce the possibility of burn-in, the display system 20 changes the power supply characteristics to limit instantaneous power supplied to the panel while possibly permitting the average power consumption of the display system to increase.

Thus, the threshold detector 26 switches between a first power supply circuit 30 and a second supply power circuit 32 based upon the temperature of the panel 22 as determined by the temperature sensor 24. One of the first and second power supply circuits 30, 32 then supplies power to the drive circuitry 36, column and row drivers 38, which in turn drive the ELD panel 22 in a known manner.

The first power supply circuitry 30 is of a type generally known for minimizing average power consumption of the entire display system 20, including the drive circuitry 36, the column and row drivers 38, and FPGA, the power convertor, etc (not shown). The preferred power supply circuitry 30 is described in more detail in copending U.S. application Ser. No. 08/784,616 filed Jan. 21, 1997 entitled "Power Consumption Control For A Visual Screen Display" the assignee of which is the assignee of the present invention and which is hereby incorporated by reference. Alternatively, the first display circuitry may include a simple resonant circuit, such an inductor which would be connected in series with the panel 22. As is generally known for ELDs, the voltage differences between column and row electrodes are rapidly changed to illuminate pixels on the panel 22. While the voltage difference is being changed, e.g. the drive circuitry 36 and column drivers 38 are driving column or row electrodes from a zero voltage difference to a high voltage difference, the instantaneous power supply to the panel 22 may include very high peaks, even though the first power supply circuitry 30 minimizes average power consumption. These instantaneous power consumption peaks are not harmful to the panel 22 when the temperature sensor 24 indicates that the panel 22 is cool. However, when the temperature sensor 24 indicates that the panel 22 is above the threshold, these instantaneous peaks of power consumption would worsen burn-in of the panel 22.

The second power supply circuitry 32 provides power to the drive circuitry 36 and column and row drivers 38 when the ELD panel 22 is hot. The second power supply circuitry 32 limits instantaneous power supplied to the panel 22, thereby preventing burn-in when the panel 22 is hot. The second power supply circuitry 32 includes a constant power source 40, such as a constant power amplifier. The constant power source 40 supplies constant power to the panel 22 in order to change the voltage differences between column and row electrodes. With the target voltage is reached, the constant power source 40 then maintains the constant voltage. For example, when changing the potential difference between column and row electrodes from zero to 200 volts in a predetermined time, such as five microseconds, the second power supply circuitry 32 supplies constant power to the panel 22, thereby reducing the potential for burn-in.

It should be recognized that the particular threshold utilized will depend upon the specific characteristics of the ELD panel 22 used. Further, the threshold detector 26 may include a hysterisis, in order to prevent oscillation between the first and second power supply circuits 30, 32. For example, the threshold detector 26 could switch to the first power supply circuit 30 when the temperature is 120 degrees or below and switch to the second power supply circuit 32 when the temperature is 150 degrees or above.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A display system comprising:

a temperature sensor for a display panel;

a first power supply circuit, which together with the display system, consumes a first average power and a first peak power when the temperature sensor indicates that the temperature is below a threshold; and a second power supply circuit which, together with the display system, consumes a second average power and a second peak power when the temperature sensor is above said threshold, said second average power exceeding said first average power, said first peak power exceeding said second peak power.

2. A display system of claim 1 further including an electroluminescent display having a glass, said temperature sensor monitoring the temperature of the glass.

3. The display system of claim 1 wherein said second power circuit supplies a generally constant power when the display is changing a voltage level.

4. A method for supplying power to a display including the steps of:

(a) monitoring a temperature of a display panel;

(b) comparing said temperature of said panel to a threshold;

(c) generating a first power output having a first average power and a first peak power when the temperature is below said threshold; and (d) generating a second power output having a second average power greater than said first average power and a second peak power less than said first peak power when said temperature sensor exceeds said threshold.

* * * * *